United States Patent [19]

Manusch et al.

[11] Patent Number: 4,759,651

[45] Date of Patent: Jul. 26, 1988

[54] WRITING INSTRUMENT WITH A SIGNAL CAP

[75] Inventors: Christoph Manusch, Hanover; Günter Scholz, Garbsen; Udo Obersteller, Langenhagen; Heinrich Schoop, Isernhagen; Friedrich Dralle, Seelze; Manfred Brümmer, Marklohe; Uwe Femmer, Peine; Christian Hofmann, Burgdorf; Günter Ulrich, Hanover, all of Fed. Rep. of Germany

[73] Assignee: Pelikan AG, Hanover, Fed. Rep. of Germany

[21] Appl. No.: 922,304

[22] Filed: Oct. 23, 1986

[30] Foreign Application Priority Data

Oct. 25, 1985 [DE] Fed. Rep. of Germany ..... 3538077

[51] Int. Cl.[4] ..... B43K 9/00

[52] U.S. Cl. ..... 401/194; 401/192; 401/202; 401/243; 401/247

[58] Field of Search ..... 401/243, 247, 202, 244, 401/194, 245, 246, 192

[56] References Cited

U.S. PATENT DOCUMENTS

| | | | |
|---|---|---|---|
| 1,838,543 | 12/1931 | Goldstein . | |
| 2,453,491 | 11/1948 | Cardin | 401/244 |
| 2,808,670 | 10/1957 | Katz . | |

FOREIGN PATENT DOCUMENTS

| | | | |
|---|---|---|---|
| 827760 | 1/1952 | Fed. Rep. of Germany . | |
| 945818 | 6/1956 | Fed. Rep. of Germany | 401/246 |
| 6911249 | 3/1969 | Fed. Rep. of Germany . | |
| 7202274 | 1/1972 | Fed. Rep. of Germany . | |
| 7222646 | 6/1972 | Fed. Rep. of Germany . | |
| 7314439 | 4/1973 | Fed. Rep. of Germany . | |
| 2356981 | 5/1974 | Fed. Rep. of Germany | 401/245 |
| 0082270 | 6/1983 | Fed. Rep. of Germany . | |
| 0121379 | 10/1984 | Fed. Rep. of Germany . | |
| 3441435 | 8/1985 | Fed. Rep. of Germany . | |
| 3401739 | 8/1985 | Fed. Rep. of Germany . | |
| 2480679 | 10/1981 | France | 401/244 |
| 631195 | 10/1949 | United Kingdom | 401/244 |
| 1207268 | 9/1970 | United Kingdom | 401/247 |

*Primary Examiner*—Steven A. Bratlie
*Attorney, Agent, or Firm*—Herbert Dubno

[57] ABSTRACT

The cap for the writing instrument comprises a jacket mounted slidably on a sealing insert or sleeve which provides a sealed moisture chamber for the writing tip when the cap is on the writing instrument. Near the writing tip there is a circular bulge on the shaft of the writing instrument which enters into a sealing engagement with an interior passage of the sealing insert. On putting the cap on the writing instrument the sealing insert is pushed over the circular bulge until it contacts a contacting stop on the jacket. Then the circular bulge presses tightly into the sealing insert and it locks the jacket to the writing instrument so that the entire arrangement is kept in that position until the cap is removed. A signal slider is attached with the sealing insert which is extendable out from the end of the jacket in order to signal in its extended position the proper seating of the cap on the writing instrument. Erroneous indications of a sealed state are prevented with our invention.

6 Claims, 2 Drawing Sheets

WRITING INSTRUMENT WITH A SIGNAL CAP

FIELD OF THE INVENTION

Our present invention relates to an instrument for writing and, more particularly, to a writing instrument with a moist tip such as a pen, a felt marker or the like.

BACKGROUND OF THE INVENTION

A writing instrument with a cap can have a shaft on one of whose ends a moist tip is mounted and a circular bulge on the shaft adjacent to it.

The cap can have an elongated jacket which is pushed onto the shaft and in which an axially slidable sealing insert is mounted which contains at one end an open tubular sleeve shaped portion for insertion of a writing tip.

On pushing of the writing tip into the tubular sleeve-shaped portion, the circular bulge acts as a seal for the writing tip in a moist chamber. A compressible spring is provided by which the sealing insert is shiftable relative to the jacket in the direction of the writing instrument.

The sealing insert and the jacket have contacting stops to limit their opposite relative movements. The cap also can have a signal slider which is mounted in the end of the cap opposite to the writing instrument and is slidable out of it depending on the position of the sealing insert and in a locking configuration which holds the writing tip in the sealing insert.

A writing instrument with a moist point, for example, a fountain pen, a felt tip pen or the like, when it is stored covered with a cap as just described, should be sealed in a moist chamber surrounding the point in order to prevent drying out of the tip.

Particularly with a felt or fiber writing instrument, the capillaries between the fibers forming the writing tip quickly dry out and plug up and thus the flow of ink from the writing instrument is prevented so that the writing instrument, although it still may contain sufficient ink, can no longer be used and either must be cleaned with considerable effort or, as is frequently the case, is discarded.

Thus it is important that a proper seat of the cap on the writing instrument after each use be guaranteed.

There have been numerous suggestions for solution of this problem which are much too expensive for use directly with a disposable writing device, although they may be applicable in a complicated and expensive writing instrument structure.

One known writing instrument with a cap is described in U.S. Pat. No. 1,838,543 and is a fountain pen with a removable cap. Near the tip of the fountain pen a circular bulge is located on its shaft and a jacket is mounted inverted on the shaft which surrounds the circular bulge with clearance.

Inside the jacket an axially slidable sealing insert is mounted which has a tubular sleeve like portion open to the writing instrument which is surrounded by small spring clips which extend longitudinally. The ends of the spring clips facing the fountain pen are bent inwards. A compressible spring mounted between the jacket and the sealing insert presses the sealing insert in the direction of the opening of the jacket.

On the inner wall of the jacket a circular groove is formed. When the opening of the sleeve-like portion of the sealing insert facing the mouth of the jacket reaches this circular groove, the spring clips can spread to the outside and engage with their ends in the wall of the circular groove so that the sleeve is held in this position.

If the fountain pen is pushed into the jacket, its circular bulge comes into contact with the mouth of the sealing insert and can be pushed deeper into the jacket. Thus the spread out spring clips are bent back and engage under the circular bulge with their inwardly bent ends so that the bulge is gripped securely and pressed against the mouth of the sealing insert and of course so that a seal is attained.

The end of the jacket facing away from the writing instrument is closed and has an axially movable signal slider which is pressed upwards by a single coil spring. The inner end of the signal slider is provided with lock catches which contact the ball-shaped end of the signal slider inside the jacket and can engage a pin coaxial to it which is connected to the spring clips.

If the sealing insert is pushed all the way into the jacket a locking engagement with the end of the signal pin occurs. After loosening the shaft of the writing instrument it is pressed out from the jacket slightly with the sealing insert so that the signal slider is drawn into the ejected end of the jacket. A drawn in or retracted signal slider indicates that the mounting of the circular collar in the mouth of the sleeve is prevented while an extended signal slider indicates the opposite condition.

Essentially the known writing instrument functions as follows: upon putting of the jacket on the writing instrument the seal between the sealing insert and the moist chamber is made, but first this condition is indicated by the signal slider. On removing the jacket from the writing instrument, first a signal of that state in which the cap is removed is given and only then is this condition realized. Thus it is guaranteed that a timely signal is provided.

This great advantage is however achieved at great expense and requires a complicated structure. Moreover the known mechanism is not completely reliable: upon an erroneous insertion of the writing instrument into the jacket or on upon the bending of one of the spring clips there is the danger that the circular bulge will not enter the mouth of the sleeve but will engage an inwardly bent end of a clip spring.

In this case the sealing insert is pushed onto the jacket, the clip spring assuming its engaged position and the signal slider indicating a sealed condition without any real engagement between the sealing insert and the writing instrument occurring. The circular bulge then does not lie claw between the mouth and the claw-like end of the clip spring, but outside of this region.

In order that the operation of this known instrument not be impaired, the jacket must be slidable against the shaft with comparatively large play. Now only an inadequate seal between the circular bulge and the mouth of the sleeve occurs, so that the eventual drying out of the writing tip cannot be prevented.

From the German Open Patent Applications Nos. 34 01 739 and 34 41 435 writing instrument caps are known which have a sealing insert slidable in a longitudinal direction which is movable over the writing instrument, the writing instrument being inserted against friction in a tubular sleeve-shaped portion of the sealing insert or withdrawable out from it. In the sealing insert a signal pin is mounted which is detectable when the insert is completely shoved onto the writing tip. The axial motion of the sealing insert is controlled by a limited locking force which is designed that the limited force is smaller in unlocking and greater in locking than the frictional force to be overcome in sliding in or pulling out the writing tip.

When with the known writing instrument as a result of use or because of an unwanted lubricant the frictional force is reduced on pulling out the writing tip so that the above named relationships are not maintained, it can not be guaranteed that the sealing insert will remain in its position facing away from the opening of the cap after the writing tip has been drawn out. The signal pin thus may indicate erroneously a sealed seating of the writing instrument in the cap.

German Utility Model DE-GM No. 73 14 439 describes a fountain pen which has a sealing insert into which the shaft of a writing instrument can be pushed. The writing instrument is provided with a circular bulge which is engaged by a corresponding sealing surface of the sealing insert with the writing instrument inserted. An indication of the sealed seating of the writing instrument is not provided with the known cap used in this fountain pen.

German Utility Model DE-GM No. 72 22 646 relates to a locking cap of a fountain pen in which the cap or its jacket locks on the shaft of the writing instrument. A circular groove is provided on the shaft which cooperates with a corresponding locking strip on the upper surface of the cap or the jacket.

A similar locking between a writing instrument cap and a shaft is provided in German Utility Model DE-GM No. 69 11 249 wherein the shaft of the writing instrument is provided with a circular bulge and the inside of the cap with a corresponding opposing groove.

German Patent DE-PS No. 827 760 involves a fountain pen with a cap which is screwed on. The closing cap contains an axially slidable sealing insert. The sealing insert is kept under tension by a spring in the direction of the open end of the cap. An indication as to the state of the seal of the writing instrument tip is not provided in the three last-mentioned writing instruments.

OBJECTS OF THE INVENTION

It is an object of our invention to provide an improved writing instrument, particularly an improved writing instrument with a moist tip such as a pen, a felt marker or the like, which avoids the above-mentioned drawbacks.

It is also an object of our invention to provide an improved writing instrument which retains the above named advantages but has a considerably simplified structure.

It is another object of our invention to provide an improved writing instrument in which an erroneous indication of a sealed condition for the moist tip of the writing instrument is prevented.

SUMMARY OF THE INVENTION

These objects and others which will become more readily apparent hereinafter are attained in accordance with our invention in a writing instrument with a cap which has a shaft on whose end a moist tip is mounted and a circular bulge located on the shaft adjacent to it.

The cap has an elongated jacket pushed on the shaft in which an axially slidable sealing insert is mounted which contains at one end an open tubular sleeve-shaped section for insertion of the writing tip, whereby on pushing on the writing tip the tubular sleeve-shaped section is closed with the circular bulge and the writing tip is sealed in a moist chamber. A compressible spring allows the sealing insert to slide relative to the jacket in the direction of the writing instrument. The sealing insert and the jacket have contacting stops to limit their opposing relative motions. The cap also has a signal slider which is mounted in the end of the cap opposite to the writing tip and is slidable out of it depending on the position of the sealing insert and into a locking device which holds the writing tip in the sealing insert.

According to our invention the circular bulge is slid into the sealing insert and is brought into a tightly clamped engagement with an interior passage of the tubular sleeve-shaped portion, the locking device comprises a circular strip or an opposing groove on the inner surface of the jacket, whereby between the circular bulge and the locking device an axial space is provided so that a locking engagement can be made when the sealing insert sits at a limit of travel of the sealing insert at one of the contacting stops and the circular bulge is tightly forced into the sealing insert.

Our invention thus provides a surprisingly simple structure which is completely effective and reliable. In our pen a circular strip is provided on the shaft of the writing instrument which no longer, as previously was the case, seals against the mouth of the sealing insert, but is pushed in the jacket, whereby it contacts tightly on the inner wall of the jacket during the entire insertion process in each of its positions.

In the writing instrument according to our invention, moreover, the locking mechanism is no longer between the sealing insert and the shaft but between the latter and the jacket, whereby the locking position is so arranged that a locking engagement can first occur upon shoving on of the jacket, when the sealing insert engages its contacting stop in the jacket and the circular strip is forced sufficiently far into the jacket in order to provide the desired seal.

This means that a locking position is attained in which the desired sealing of the moisture chamber is made. Should the jacket be loose it is pushed back from the writing tip again by the spring and of course then is pulled off the circular strip even though the circular bulge was already pushed on the sealing insert. The user at once will easily determine that the desired locked position has not been attained.

The signal slider is rigidly attached to the sealing insert and projects from the end of the jacket when the proper sealing engagement is present. Thus the signal slider can project from the jacket only when it is held in its pushed back position, i.e. when the locking engagement between the jacket and the shaft occurs.

If, upon sliding of the jacket on the writing instrument, the locking engagement has not occurred or the engagement has already loosened upon drawing the jacket from the writing instrument, then the spring acting between the jacket and the sealing insert slides the jacket on loosening to such a distance relative to the sealing insert that the signal slider attached rigidly with it is no longer visible from the exterior.

The locking engagement is attained by a combination of press fitting and frictional engagements by the circular strip formed on the surface of the shaft of the writing instrument and/or on the inner surface of the jacket and/or by a circular groove formed inside on the jacket opposing the circular strip on the shaft.

The closed writing instrument according to our invention has the shaft with the writing tip, the jacket, the sealing insert and the spring. It can be made in a simple economical structure and is more reliable than the known writing instruments with their many and complicated components. Finally it prevents erroneous indication of the inserted position when a proper sealing engagement has not been attained.

According to a feature of our invention in the jacket an interior circular flange is formed which, together with the opposing stops which are formed on the sealing insert, forms with its surfaces directed in the axial direction the contacting stops for the motion of the sealing insert relative to the jacket. The particular advantage of this arrangement is that the elements forming the stops for the sealing insert need not engage against each other in a complicated way but may be simply constructed. Otherwise the length of the sealing insert can be excessive. Thus this feature results in the structural simplification of the writing instrument according to our invention.

In order to attain a partial savings according to an advantageous form of the invention one of the opposing stops is formed as a flexible catch so that the sealing insert with its opposing stops is guided through the assembly in the writing direction by the circular flange which, however, can not pass in the opposite direction on account of the flexible outward displacement of the catches. Advantageously the catches are associated with each contacting stop and prevent the ejection of the sealing insert from the jacket in the direction of the writing tip.

According to another feature of our invention the jacket is provided with a viewing cap which surrounds the signal slider at its outer end position. The viewing cap of the jacket not only guarantees against the introduction of dirt but also improper inward pressing of the signal slider.

The jacket of the writing instrument according to our invention overlaps the shaft of the writing instrument. In another feature of our invention a first shoulder forming a circular groove between the shaft and the circular strip and a radial second shoulder between the circular bulge and the circular strip and/or the mount of the shaft having the circular groove have such dimensions that when the jacket is pushed still further on the shaft it seats on the first shoulder while a clearance remains between the mouth of the sealing insert and the radial second shoulder.

The jacket seats on the first shoulder before the mouth of the sealing insert has reached the second shoulder. Hence, even with an overly strong insertion of the jacket on the shaft as can occur with a careless user, the writing tip can not contact against the base of the portion of the tubular sleeve-shaped portion.

Hence, the writing tip is always protected and moreover sits in a well sealed moisture chamber with optimum volume.

The sealing engagement between the circular strip and inner wall of the sealing insert is reliably adjusted continuously so that the sealing insert is pushed only so far on the writing instrument as a result of the jacket being pushed on the writing instrument and the writing instrument is moved out from the sealing insert when the jacket is drawn from the writing instrument.

Essentially in the invention the key is the bearing surfaces or contacting stops which are effective between the sealing insert and the jacket. Advantageously, in the jacket taken from the writing instrument the sleeve or sealing insert end facing the shaft projects from the jacket. The advantage of this arrangement is particularly pronounced when with a neutral colored jacket the material of the sealing insert formed in a single piece is colored uniformly in a color coordinated with the writing color of the writing instrument. Then with the jacket put on the signal slider indicates the color of the writing fluid of the writing instrument while the end of the sleeve or the sealing insert projecting from it is the same color so that a jacket not belonging to the writing instrument will not be put together with the writing instrument.

The holding force of the locking mechanism exceeds in the sliding direction the restoring force of the spring.

BRIEF DESCRIPTION OF THE DRAWING

The above and other objects, features and advantages of our invention will become more readily apparent from the following description, reference being made to the accompanying drawing in which.

DESCRIPTION

Figure 1:
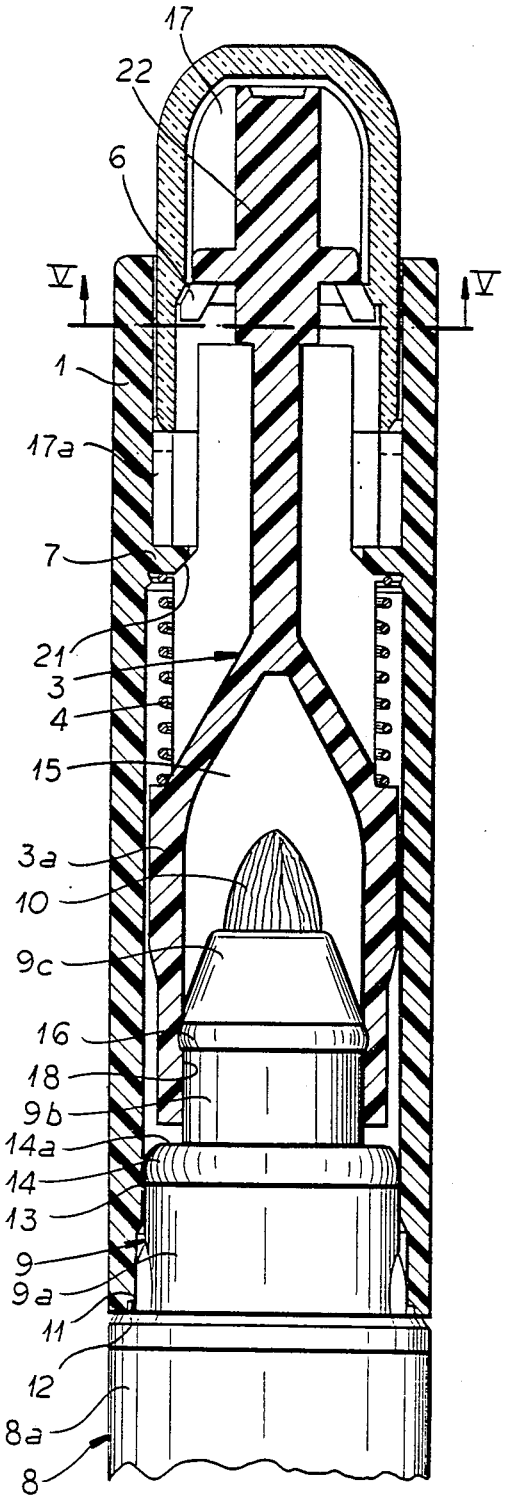
FIG. 1 is an axial section through the pen and cap with the pen inserted therein.
Figure 2:
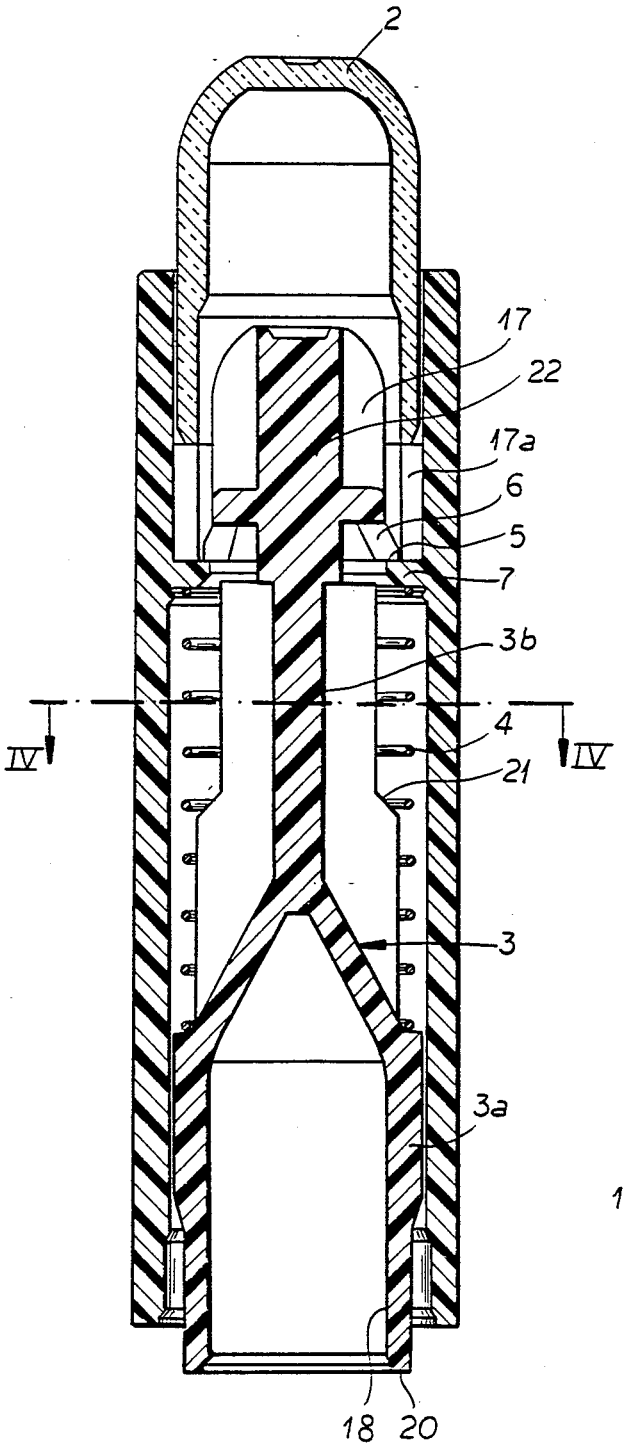
FIG. 2 is a section through the cap upon withdrawal of the pen tip or nib.

The terms "upper" and "lower" used in the following text relate to the drawing, assuming the writing instrument to have writing tip point upwardly. (FIGS. 1 and 2).

The drawing shows a writing instrument 8 which has an elongated substantially circular cylindrical shaft 8*a* not shown in detail in the figure.

On the open end of the shaft 8*a* a mount 9 is positioned whose section adjacent the shaft 8*a* goes into or becomes the shaft 8*a* outer surface and is also substantially circularly cylindrical. This section is set back radially to form a first shoulder 12 which extends substantially radially toward the axis of the writing instrument 8.

A nearly circular cylindrical slightly widened upper extension 9*a* is mounted on the first shoulder 12 which has three longitudinal ribs spaced around its circumference which extend from the shoulder 12 to approximately the center of the extension. The upper end of the extension 9*a* has a toroidal circular strip 14.

The mount 9 is set back radially at the upper end of the circular strip 14 forming a second shoulder 14*a* extending substantially radially inwardly.

At the radial inner circumferential edge of the second shoulder 14*a* a circular cylindrical section 9*b* extending upwardly is mounted which ends in a circular bulge 16 projecting only slightly radially and from whose top side the mount 9 extends further as a tapered truncated cone 9*c* and ends in an opening in which a moist writing tip 10 is mounted. On the mount 9 of the writing instrument 8 a cap can be fitted which comprises a jacket 1, a viewing cap 2, a sealing insert 3 and a compressible coil spring 4.

The jacket 1 is on its exterior formed like a substantially circularly cylindrical elongated connector tube whose outer circumference substantially corresponds to that of the shaft 8*a* of the writing instrument 8. On its end facing the circular collar 12 the jacket 1 has a radial contacting surface which bounds the mouth of the interior of the jacket 1.

The jacket 1 is further provided with an interior passage, which beginning at the mouth 11 has a first cylindrical section. This first cylindrical section extends axially only slightly more than the length of the longitudinal strips and/or ribs which extend from radial inner circumference of the circular collar 12 along the outer surface of the mount 9. These three (or more) ribs are so dimensioned that they engage with the first cylindrical section under a gentle pressure on sliding on of the jacket 1.

Figure 3:
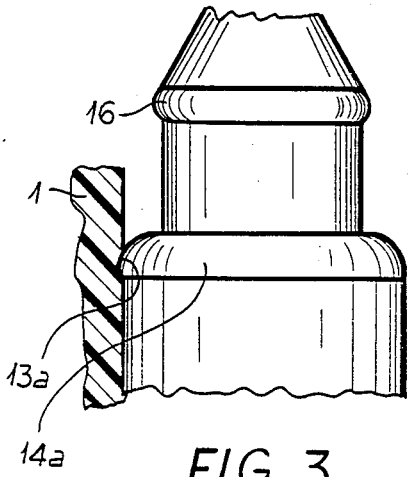
FIG. 3 is a detail view of an alternative construction.

The upper and/or inner end of the first cylindrical section of the jacket 1 projects inwardly to change over into a second comparatively long cylindrical passage section which extends over two thirds of the axial jacket length. Near the inwardly projecting portion an inwardly projecting locking strip 13 (or groove 13*a* in the embodiment of FIG. 3) is positioned which extends to and frictionally engages the strip 14 of the mount 9 when the jacket 1 is put on the writing instrument 8.

On the upper end of the second comparatively long circular cylindrical passage section of the jacket 1 an inwardly projecting circular flange 7 is formed with a substantially radially directed upper surface and a substantially radially running lower surface whose end is however beveled in a truncated conical shape. The interiorly directed circular flange 7 is shown in the figure as a continuous flange however it can also be divided into separate projections in a different embodiment of our invention.

From the top end of the circular flange 7 a third circular cylindrical passage section extends to the upper end of the jacket 1 and has an inner diameter which is a little smaller than the second elongated passage section.

In the upper portion of the third cylindrical passage section a circular bulge can be formed which extends only slightly radially inwardly.

On the lower end of the third passage section at its interior circumferential surface axial bars 17*a* are formed which end in a common radial plane.

Here from above the viewing cap 2 is pushed into the third passage section. The cap 2 is composed of a transparent plastic piece and has a tubelike section closed at its top end, pushed into the opening of the third passage section of the and is seated upon the upwardly directed surface of the axial bars 17*a*.

The sealing insert 3 as seen from below to above has a first substantially tubular sleeve-shaped portion 3*a* with an end surface 20 directed downwardly and an exactly circular cylindrical inner surface 18. The upper part of this tubular sleeve-shaped portion 3*a* is widened exteriorly so that the tubular sleeve-shaped portion 3*a* can be satisfactorily fit in the second passage section of the jacket 1.

Figure 4:
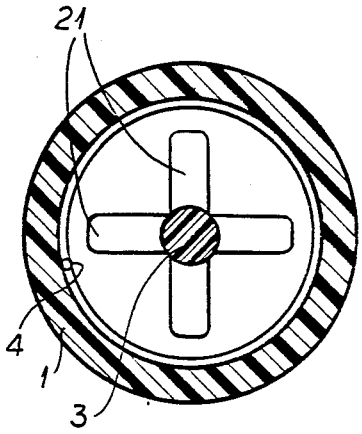
FIG. 4 is a section along line IV—IV of FIG. 2.

The enlarged tubular sleeve-shaped portion 3*a* is extended to the exterior at its upper end under a shoulder of the sealing insert. Between the shoulder and the lower radial surface of the circular flange 7 the compressible coil spring 4 is mounted (FIG. 4).

On the upper end of the third cylindrical portion of the sealing insert 3 is a cone shaped portion which goes into a central member 3*b* extending upwardly. The interior of the conical portion forms a moist chamber 15 (FIG. 1).

The inner diameter of the passage 18 of the tubular sleeve-shaped portion of the insert 3 is adjusted to the outer diameter of the circular bulge 16 so that it is sealed and may be pressed into the passage 18 with a gentle pressure, whereby the moist chamber 15 receiving the writing tip 10 between the upper part of the mount 9 and the truncated cone portion of the sealing insert 3 is closed.

Parallel to the central member 3*b* extending upwardly from the tubular sleeve-shaped portion 3*a* are four longitudinal ribs mounted on the central member 3*b* spaced circumferentially extending axially and projecting radially outwardly. These longitudinal ribs have in their axially central portion a beveled shoulder 21 projecting radially (FIG. 4). This beveled shoulder 21 supports itself in the position shown in the left portion of the drawing exactly on the corresponding cone shaped surface on the underside of the circular flange 7 and forms with it a contacting stop which bounds the motion of the sealing insert 3 in the jacket 1 and limits the motion of the writing tip 10 in the upward direction.

The top end of the central member 3*b* is extended around a signal slider 17 which comprises a central pin 22 and a flange at its lower end.

Figure 5:
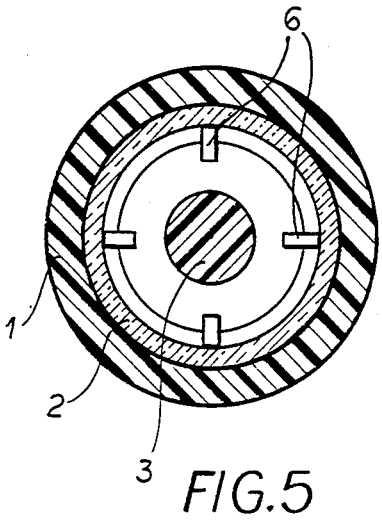
FIG. 5 is a section along line V—V of FIG. 1.

On the lower side of the flange of the signal slider 17 resilient catches 6 (FIG. 5) are provided on opposite sides of the flange 22 and have surfaces directed downwardly and lying in a radial plane.

In FIG. 2, the sealing insert 3 is shown to have been pressed by the compressible spring 4 from the jacket 1 until the portion of the sealing insert 3 having the end surface 20 projects from the jacket 1 and the radial surface on the underside of the catches 6 seats on the radial surface of the flange 7, whereby the second contacting stop for the motion of the sealing insert 3 is formed.

When the instrument is inserted in the cap, the beveled shoulders 21 of the longitudinal ribs of the sealing insert 3 contact from below against the flange 7. The the signal slider 17 extends into the interior of the transparent viewing cap 2 so that it can be seen well from the outside. When the jacket 1 of the writing instrument 8 is pulled off or does not side properly on it the signal slider 17 takes the position shown in FIG. 2 in which it is completely drawn back into the interior of the jacket 1 and is no longer detectable from the outside.

As is apparent from FIG. 1, on insertion of the writing instrument 8 with its mount 9 into the passage 18 of the sealing insert 3 the circular bulge 16 comes into contact with the set back edge of the end surface 20 so the circular bulge 16 is conducted into the passage 18.

On further insertion of the writing instrument 8 into the jacket 1 the sealing insert 3 is pushed by the circular bulge 16 against the action of the compressible spring 4 until the beveled shoulder 21 comes into contact with the underside of the flange 7. Since the sealing insert 3 can no longer move into the jacket 1 (on further application of an effective sliding force), the mount 9 is forced with the circular bulge 16 into the passage 18. Thus the circular strip 14 (or 14*a* in FIG. 3) enters the interior of the jacket 1 sliding past the inclined portion between the first and second passages passing the lock strip 13 which is on the inner surface of the jacket 1 and engages it (or in the groove 13*a* of FIG. 3) so that a locking engagement is made. Directly after the locking engagement is made the mouth 11 of the jacket 1 contacts on the shoulder 12 so that the jacket 1 no longer can be shoved toward the mount 9.

If the jacket 1 is set loose in this position it can no longer spring away from the mount 9 under the force of the compressible spring 4 since the locking engagement between both locking strip 13 and the circular strip 14

(or groove 13*a* and bulge 14*a*) is so strong that it can not be overcome by the force of the compressible spring 4.

In this position the signal slider 17 appears in the viewing cap 2 and indicates that the proper sealing of the moist chamber 15 has occurred.

As FIG. 1 shows, the radial second shoulder bounding the top end of the circular strip 14 is in a position opposing the end surface 20 of the sealing insert 3 however with spacing from the end surface 20 while simultaneously the mouth 11 and the shoulder 12 seat on each other. Thus damage to the writing tip 10 by pushing the cap on the writing instrument 8 too strongly so the writing tip 10 travels too far into the sealing insert 3 is avoided by contact on the stops formed by the shoulder and flange 7, 21.

On drawing off the jacket 1 from the writing instrument 8 the engagement between the circular strip 14 and the lock strips 13 is lost. If the jacket 1 is released, it is pushed immediately by the compressible spring 4 upwardly, whereby the signal slider disappears from the viewing cap 2. Now the contacting stop formed by the catch and flange 5,7 comes into play. If one pulls the jacket 1 still more, the pulling force is transmitted to the sealing insert 3 and it is pulled away from the writing instrument 8, whereby the circular bulge 16 which is engaged with the inner surface of the passage 18 is pulled from it. After this release is effected the cap can be removed from the writing instrument and it can be used. The lower portion of the sealing insert 3 projects from the jacket 1 on removal of the cap compare FIGS. 1 and 2.

The sealing insert 3 is colored in a color which corresponds to the color used in the writing fluid and similarly the same color is used for the signal slider 17 and the portion projecting out from the jacket 1 so that both with the cap put on and also with the cap removed the user can know which writing instrument this cap belongs to.

We claim:

1. A writing instrument, comprising:

a writing body having a writing end formed with:

a moist writing tip, a cylindrical mount receiving said moist writing tip and formed with a circumferential bulge, and a cylindrical body portion adjoining said mount and of a diameter greater than that of said mount, said cylindrical body portion having a locking strip axially spaced from said mount; and a cap fitting removably over said writing end and comprising:

a jacket-forming outer sleeve having:

a mouth at one end of said sleeve adapted to receive said cylindrical body portion, viewing means at an opposite end of said sleeve for enabling viewing of a state of sealing of said cap on said writing body, means forming an annular locking strip on an inner wall of said outer sleeve inwardly of said one end thereof for locking engagement with said locking strip of said cylindrical body portion to resist withdrawal of said sleeve from said writing body, and means forming a stop in said sleeve between said annular locking strip on said sleeve and said opposite end, a sealing insert axially displaceable in said outer sleeve and having:

a tubular sleeve-shaped portion opening in the direction of said one end, dimensioned to receive said mount, defining a moist chamber receiving said tip with clearance, and formed with means on an inner wall of said tubular sleeve-shaped portion engageable sealingly with said bulge upon insertion of said mount into said tubular sleeve-shaped portion with a force sufficient to enable said tubular sleeve-shaped portion to be entrained in a direction toward said stop, means on said sealing insert forming a further stop engageable with said stop in said sleeve upon entrainment of said tubular sleeve-shaped portion in said direction by a distance sufficient to permit said means on said inner wall of said tubular sleeve-shaped portion to engage sealingly with said bulge and said annular locking strip to come into locking engagement with said locking strip of said cylindrical body portion, and a signal slider formed on said sleeve-shaped portion and displaceable therewith into said viewing means upon engagement of said stops and sealing engagement of said means on said inner wall of said tubular sleeve-shaped portion with said bulge, to display through said viewing means a sealed state of said chamber and said tip therein, and a coil spring braced between said outer sleeve and said sealing insert for resiliently resisting displacement of said sealing insert in said direction and, upon release of said locking engagement annular locking strip of said outer sleeve with said locking strip of said cylindrical body portion, displacing said sealing insert toward said one end, said bulge and said locking strip of said cylindrical body portion being axially spaced by a distance such that said locking engagement is only established when said stops have engaged and said bulge is in sealing engagement with said means on said inner wall of said tubular sleeve-shaped portion.

2. The writing instrument defined in claim 1 wherein said stop in said sleeve is formed as an inwardly projecting circular flange having opposite sides turned toward said sealing insert for engagement by said further stop and for engagement with said signal slider.

3. The writing instrument defined in claim 2 wherein said signal slider is formed with a flexible catch constituting another stop engageable with said flange and displaceable past said flange upon insertion of said insert into said sleeve.

4. The writing instrument defined in claim 3 wherein said viewing means includes a view cap surrounding said signal slider upon display of said signal slider through said viewing means.

5. The writing instrument defined in claim 1 wherein said writing body is formed with a first annular shoulder between said body portion and said mount and a second annular shoulder spaced from said locking strip of said cylinder body portion away from said tip, said second annular shoulder being abutted by said sleeve in a position in which said locking strips lockingly engage and said bulge is engaged with said means on said inner wall of said tubular sleeve-shaped portion engageable sealing with said bulge, said tubular sleeve-shaped portion being spaced from said first shoulder.

6. The writing instrument defined in claim 1 wherein said stops are so positioned and said sealing insert is so dimensioned that upon removal of said cap from said writing body, said spring presses said sealing insert out of said mouth of said sleeve to reveal a color of said sealing insert corresponding to the color of said tip.

* * * * *